US006811075B2

(12) United States Patent
Sloot

(10) Patent No.: US 6,811,075 B2
(45) Date of Patent: Nov. 2, 2004

(54) COIN WRAPPER AND METHOD OF WRAPPING COINS USING COIN WRAPPER

(75) Inventor: Alexander Sloot, Sugarloaf, PA (US)

(73) Assignee: Printmark Industries, Inc., Hazleton, PA (US)

( * ) Notice: Subject to any disclaimer, the term of this patent is extended or adjusted under 35 U.S.C. 154(b) by 0 days.

(21) Appl. No.: 10/320,283

(22) Filed: Dec. 16, 2002

(65) Prior Publication Data

US 2004/0112013 A1 Jun. 17, 2004

(51) Int. Cl.[7] ..... B65D 65/04
(52) U.S. Cl. ..... 229/87.2
(58) Field of Search ..... 229/87.2

(56) References Cited

U.S. PATENT DOCUMENTS

| | | | | | |
|---|---|---|---|---|---|
| 1,338,941 | A | | 4/1920 | Morgan | |
| 1,379,751 | A | * | 5/1921 | Downey | 229/87.2 |
| 1,420,285 | A | | 6/1922 | Reinhold | |
| 1,511,188 | A | * | 10/1924 | Spurgin et al. | 229/87.2 |
| 1,717,669 | A | * | 6/1929 | Downey | 229/87.2 |
| 2,042,022 | A | * | 5/1936 | Schmocker | 229/87.2 |
| 2,168,504 | A | * | 8/1939 | Youmans | 229/87.2 |
| 2,194,904 | A | * | 3/1940 | Jackson | 229/87.2 |
| 2,260,150 | A | * | 10/1941 | Millard | 229/87.2 |
| 2,331,188 | A | * | 10/1943 | Head | 229/87.2 |
| 2,507,626 | A | * | 5/1950 | Ekstrand | 493/288 |
| 3,347,450 | A | * | 10/1967 | Godwin | 229/87.2 |
| 3,533,501 | A | * | 10/1970 | Dorsett | 206/82 |
| 4,014,155 | A | | 3/1977 | Izawa et al. | |
| 4,384,644 | A | | 5/1983 | Uchida | |
| 4,409,773 | A | | 10/1983 | Bergman et al. | |
| 4,546,875 | A | * | 10/1985 | Zweber | 206/82 |
| 4,996,822 | A | | 3/1991 | Truppe | |
| 5,006,091 | A | * | 4/1991 | Reavley | 453/59 |
| 5,457,931 | A | | 10/1995 | Kurata et al. | |

* cited by examiner

*Primary Examiner*—Jes F. Pascua
(74) *Attorney, Agent, or Firm*—St. Onge Steward Johnston & Reens LLC.

(57) ABSTRACT

A wrapper for wrapping a stack of coins is formed by a flat sheet of paper having first and second opposite edges generally parallel with each other, an adhesive applied to an area of the sheet of paper adjacent to at least one of the first edge or the second edge, and first and second score lines generally parallel with the first and second edges for facilitating folding of the sheet of paper. The first and second score lines are spaced such that when the first edge is folded over onto itself along the first score line and the second edge is folded over onto itself toward the first edge along the second score line, the first and second edges overlie and the sheet of paper adheres to itself in the area of the adhesive, thereby forming a sleeve, which when opened, has a diameter corresponding to a diameter of the stack of coins.

17 Claims, 9 Drawing Sheets

COIN WRAPPER AND METHOD OF WRAPPING COINS USING COIN WRAPPER

FIELD OF THE INVENTION

The present invention relates to an improved wrapper for wrapping coins, tokens and the like and to a method of wrapping coins, tokens and the like using the improved wrapper.

BACKGROUND OF THE INVENTION

Many types of coin packaging materials and various designs incorporating such packaging materials are well known in commerce and industry. Examples of packaging materials which have been used to hold coins include paper, plastic, cardboard and similar materials.

Local banks typically provide Kraft paper and other paper wrappers for coins, which wrappers usually come with a designation of the type of coin and the capacity of the wrapper printed on the outside of the flat paper "tube". Plastic wrappers are also available usually in the form of a vacuum formed plastic, which conform to the size of the coins to be packed. Such coin wrapping materials are also available for sale in retail stores. These are usually sold with some type of "coin selection" device which automatically allows different coins to drop into their appropriate slots to sort them into size and value type.

The wrappers which are given away by banks or sold in stores are usually printed with the coin description on the outside of the wrapper. This description is usually linked to some kind of color coding. For example a wrapper for pennies (typically with a $0.50 capacity) may be printed with red ink, a wrapper for nickels (typically with a $2.00 capacity) may be printed with blue ink, a wrapper for dimes (typically with a $5.00 capacity) may be printed with green ink, and a wrapper for quarters (typically with a $10.00 capacity) may be printed with orange ink. In other countries, such as Canada, the terms "dimes", "nickels" and/or "quarters" may not be used. The coin wrappers in these countries are similar but the notation on the outside may be different, for example, the notation "$10.00 25 c" may be printed thereon, which would mean $10.00 worth of 25 c pieces.

The designs of the particular coin packaging systems incorporating the above-discussed materials are numerous. One traditional design for coin wrappers was to provide a paper sleeve which starts out flat, but which is glued along one edge. It is made into a "tube" by squeezing the two folded edges towards each other. The coins, which have been previously counted to the correct number, are then inserted into this tube or sleeve. The ends are folded over and the coins are reasonably secure within this paper tube. These sleeves are generally made automatically on equipment which prints the wrap with a one color coin denomination, and which folds the paper, glues it and cuts it to size (all done in-line), thereby delivering completed coin-wrap sleeves automatically. However this traditional design suffers from a number of disadvantages. One of such disadvantages if that the design does not lend itself to any type of attractive decorating and/or to short-run custom decorating/printing. Another disadvantage is that the design does not allow the wraps to be provided as joined-together sets, and certainly not as joined together sets comprising different coin denominations in the same set.

Another system and method for wrapping coins is by use of a wrapping machine, such as are disclosed in U.S. Pat. Nos. 4,014,155, 4,384,644, 4,409,773 and 5,457,931. In this method, a flat piece of paper is wrapped around a stack of coins and is held closed therearound due to the fact that the ends are curled closed (i.e. tightly rolled over) by machine. Such machines typically operate by automatically counting the coins to create a stack of coins having the appropriate number, and then unwinding the flat piece of paper off a roll of paper, wrapping the coin roll with the paper, and edge-curling the paper (no glue or adhesive is typically needed to hold this type of coin wrap together). Banks use this type of equipment for rolling coins. However, a disadvantage of this coin wrapping method is that due to the complexity, cost and size of the special machinery needed to curl the edges of the paper, this method is typically only feasible for use by banks or other entities which handle a large amount of coins. As such, this coin wrapping method is not practicable for a person who would like to occasionally wrap his/her coins in his/her home.

Another method to hold coins in pre-counted stacks is to use clear plastic tubes. These are generally vacuum formed in either a hinged single-part, or snap-together two-part configuration. In either case these can be snapped closed by hand. Alternatively they may be sealed closed by machine. A disadvantage of this method is that although one can see through the clear plastic to see what type of coins are inside, it would be impractical to try to print on the molded "housing". Another disadvantage is that a pre-formed shape takes up much more space than flat paper sleeves, so this type of rolled coin holder is not easily stored.

Yet another method to hold coins in pre-counted stacks is to use discrete flat sheets of coin wrapping paper which are manually wrapped around a pre-counted stack of coins. An example of such a method is disclosed in U.S. Pat. No. 4,996,822. Using the method disclosed in this patent, a pad of wrapper sheets are disposed within a base having an end wall and two side walls which initially support a pre-counted stack of coins. The stack of coins is then manually rolled away from the end wall toward the opposite end of the wrapper sheet until the wrapper sheet is wrapped back onto itself. Strips of contact adhesive on the upper side of the wrapper sheets holds the wrapper to the coins and causes the wrapper sheet to adhere to itself when the wrapping is completed. A disadvantage of this method, however, is that when the stack of coins is rolled out beyond the side walls, they may easily shift, skew or fall sideways, thereby causing one or more coins in the stack not to be wrapped, or worse, preventing further rolling of the stack. As such, it would be much more desirable if a sleeve having the proper diameter for receiving the stack of coins could be created before wrapping of the coins begins.

What is desired, therefore, is a coin wrapper and a method for wrapping coins using the coin wrapper which lends itself to attractive decorating and to short-run custom decorating/printing, which allows the wraps to be provided as joined-together sets, which allows the wraps to be provided as joined-together sets comprising the same or different coin denominations in the same set, which is practicable for home use and does not require the use of large, expensive and/or complex machinery for wrapping, which is easily stored, and which allows for the creation of a sleeve having the proper diameter for receiving the stack of coins before wrapping of the coins begins to facilitate wrapping.

SUMMARY OF THE INVENTION

Accordingly, it is an object of the present invention to provide a coin wrapper and a method for wrapping coins using the coin wrapper which lends itself to attractive decorating and to short-run custom decorating/printing.

Another object of the present invention is to provide a coin wrapper and a method for wrapping coins using the coin wrapper having the above characteristics and which allows the wraps to be provided as joined-together sets.

A further object of the present invention is to provide a coin wrapper and a method for wrapping coins using the coin wrapper having the above characteristics and which allows the wraps to be provided as joined-together sets comprising different coin denominations in the same set.

Still another object of the present invention is to provide a coin wrapper and a method for wrapping coins using the coin wrapper having the above characteristics and which is practicable for home use and does not require the use of large, expensive and/or complex machinery for wrapping.

Yet a further object of the present invention is to provide a coin wrapper and a method for wrapping coins using the coin wrapper having the above characteristics and which is easily stored.

Still yet another object of the present invention is to provide a coin wrapper and a method for wrapping coins using the coin wrapper having the above characteristics and which allows for the creation of a sleeve having the proper diameter for receiving the stack of coins before wrapping of the coins begins to facilitate wrapping These and other objects of the present invention are achieved in one embodiment by provision of a wrapper for wrapping a stack of coins, the wrapper being formed by a flat sheet of paper having first and second opposite edges generally parallel with each other, an adhesive applied to an area of the sheet of paper adjacent to at least one of the first edge or the second edge, and first and second score lines generally parallel with the first and second edges for facilitating folding of the sheet of paper. The first and second score lines are spaced such that when the first edge is folded over onto itself along the first score line and the second edge is folded over onto itself toward the first edge along the second score line, the first and second edges overlie and the sheet of paper adheres to itself in the area of the adhesive, thereby forming a sleeve, which when opened, has a diameter corresponding to a diameter of the stack of coins.

The wrapper preferably includes printing on an outside surface of the sheet of paper. The printing may for example consist of printing showing a denomination of the coins, printing showing a capacity of the wrapper in terms of number of coins, printing showing a capacity of the wrapper in terms of monetary value, and combinations of these. Instead or in addition, the printing may consist of printing showing decorative designs, printing showing decorative backgrounds, and combinations of these. Further, the printing may consist of printing relating to a logo, printing relating to an advertising message and combinations of these. In addition, the printing may consist of information useful to a bank, such as printing relating to an account holder's name, printing relating to an account holder's account number, printing relating to an account holder's telephone number and combinations of these.

In some instances, the wrapper may also include printing on an inside surface of the sheet of paper. This printing may, for example, consist of information relating to advice for carefully handling one's money, information relating to savings advice, information relating to messages to children and/or adults concerning money responsibilities, promotional information, advertising information, information relating to special offers or coupons, information relating to instructions for assembling the wrapper and combinations of these.

The adhesive may, for example, be a moisture activated adhesive, in which case it may be desirable for the moisture activated adhesive to be flavored, a pressure sensitive adhesive covered with a release liner, or a contact adhesive. In the case of a contact adhesive, it would be preferable that the adhesive be applied to an area of the sheet of paper adjacent to both of the first edge and the second edge. Two or more wrappers described above may, if desired, be stacked on top of each other and separably joined together to form a pad of coin wrappers.

In another embodiment of the present invention, a set of coin wrappers for wrapping stacks of coins is provided, the set including a plurality of coin wrappers. Each of the plurality of coin wrappers is formed by a flat sheet of paper having first and second opposite edges generally parallel with each other, an adhesive applied to an area of the sheet of paper adjacent to at least one of the first edge or the second edge, and first and second score lines generally parallel with the first and second edges for facilitating folding of the sheet of paper. The first and second score lines are spaced such that when the first edge is folded over onto itself along the first score line and the second edge is folded over onto itself toward the first edge along the second score line, the first and second edges overlie and the sheet of paper adheres to itself in the area of the adhesive, thereby forming a sleeve, which when opened, has a diameter corresponding to a diameter of the stack of coins. The plurality of coin wrappers are detachably connected to one another along weakened lines which facilitate separation of the plurality of coin wrappers from each other. Preferably, the weakened lines comprise perforations.

In certain embodiments, each of the plurality of coin wrappers is configured to wrap the same denomination of coins, while in other embodiments, at least two of the plurality of coin wrappers are configured to wrap different denominations of coins. For example, one of the plurality of coin wrappers may be configured to wrap pennies, one of the plurality of coin wrappers may configured to wrap nickels, one of the plurality of coin wrappers may be configured to wrap dimes, and one of the plurality of coin wrappers may be configured to wrap quarters. In other countries, the denominations of the wrappers will conform to that each country's currency.

The set of coin wrappers may also include a supplemental section in addition to the plurality of coin wrappers, the supplemental section being detachably connected to at least one of the plurality of coin wrappers along weakened lines which facilitate separation of the supplemental section from the plurality of coin wrappers. In certain embodiments, the supplemental section may comprise an informational section containing information such as instructional information, a message to the consumer, a special offer or coupon, advertising information, a logo, and combinations of these. In other embodiments, the supplemental section may comprise a retail header section containing information such as a retail bar code, pricing information, sales information, and combinations of these. Two or more sets of coin wrappers described above may, if desired, be stacked on top of each other and separably joined together to form a pad of sets of coin wrappers.

In another embodiment of the present invention, a method of creating a coin wrapper is provided. A flat sheet of paper having first and second opposite edges generally parallel with each other is provided, and an adhesive is applied to an area of the sheet of paper adjacent to at least one of the first edge or the second edge. First and second score lines are formed generally parallel with the first and second edges for facilitating folding of the sheet of paper, the first and second score lines being spaced such that when the first edge is folded over onto itself along the first score line and the second edge is folded over onto itself toward the first edge along the second score line, the first and second edges overlie and the sheet of paper adheres to itself in the area of the adhesive, thereby forming a sleeve, which when opened, has a diameter corresponding to a diameter of the stack of coins. The method may further include the steps of printing on an outside and/or inside surface of the sheet of paper.

In still another embodiment of the present invention, a method of wrapping coins is provided. A coin wrapper is first provided, the coin wrapper comprising a flat sheet of paper having first and second opposite edges generally parallel with each other, an adhesive applied to an area of the sheet of paper adjacent to at least one of the first edge or the second edge, and first and second score lines generally parallel with the first and second edges for facilitating folding of the sheet of paper. Next, the first edge is folded over onto itself along the first score line. Then the second edge is folded over onto itself toward the first edge along the second score line such that the first and second edges overlie and the sheet of paper adheres to itself in the area of the adhesive, thereby forming a sleeve. The sleeve is then opened such that the sleeve has a diameter corresponding to a diameter of the coins. Next, the coins are inserted into the sleeve.

In certain embodiments, the step of providing a coin wrapper may comprise the step of providing a set of coin wrappers comprising a plurality of coin wrappers detachably connected to one another along weakened lines. In this case, the method would further comprise, before the step of folding the first edge, the step of separating one of the coin wrappers from the plurality of coin wrappers along the weakened lines.

In certain embodiments a wrapper for wrapping a stack of coins includes a flat sheet of paper having first and second opposite edges generally parallel with each other and a means for engaging the first and second opposite edges together. First and second score lines are provided generally parallel with the first and second edges for facilitating folding of said sheet of paper, the first and second score lines being spaced such that when the first edge is folded over onto itself along the first score line and the second edge is folded over onto itself toward the first edge along the second score line, the first and second edges are attachable to each other with the means for engaging, thereby forming a sleeve, which when opened, has a diameter corresponding to a diameter of the stack of coins.

In some embodiments, the means for engaging may comprise an adhesive applied to an area of the sheet of paper adjacent to at least one of the first edge or the second edge. In other embodiments, the means for engaging may comprise at least one tab adjacent to one of the first edge or the second edge, and at least one corresponding slit for receiving the tab therein adjacent to the other of the first edge or the second edge.

In certain embodiments, a method of wrapping coins comprises the steps of providing a coin wrapper comprising a flat sheet of paper having first and second opposite edges generally parallel with each other, a means for engaging the first and second opposite edges together, and first and second score lines generally parallel with the first and second edges for facilitating folding of the sheet of paper. The first edge is folded over onto itself along the first score line and the second edge is folded over onto itself toward the first edge along the second score line such that the first and second edges are proximate to one another. The first and second edges are attached to each other with the means for engaging, thereby forming a sleeve. The sleeve is opened such that the sleeve has a diameter corresponding to a diameter of the coins, and the coins are inserted into the sleeve.

In some embodiments, the means for engaging comprises an adhesive applied to an area of the sheet of paper adjacent to at least one of the first edge or the second edge, and the attaching step comprises the step of adhering the first and second edges to each other with the adhesive. In other embodiments, the means for engaging comprises at least one tab adjacent to one of the first edge or the second edge and at least one corresponding slit for receiving the tab therein adjacent to the other of the first edge or the second edge, and the attaching step comprises the step of inserting the at least one tab into the at least one corresponding slit.

The invention and its particular features and advantages will become more apparent from the following detailed description considered with reference to the accompanying drawings.

DETAILED DESCRIPTION OF AN EMBODIMENT OF THE INVENTION

Figure 1:
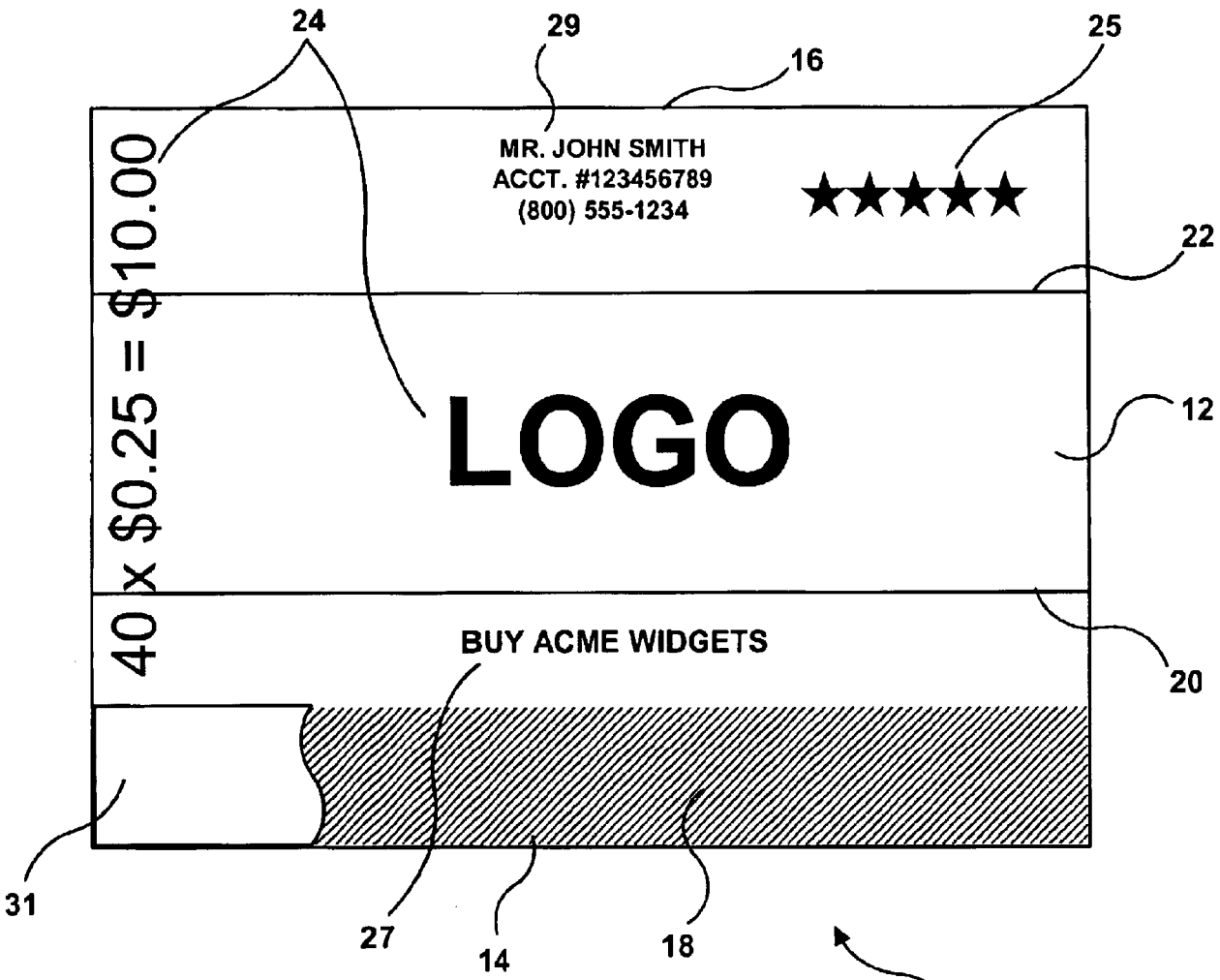
FIG. 1 is a plan view of a coin wrapper in accordance with one embodiment of the present invention.

Referring first to FIG. 1, a wrapper 10 for wrapping a stack of coins in accordance with the present invention is shown. The wrapper 10 is formed by a flat sheet of paper 12 having first 14 and second 16 opposite edges generally parallel with each other. An adhesive 18 is applied to an area of the sheet of paper 12 adjacent to at least one of the first edge 14 or the second edge 16. In FIG. 1, adhesive is shown applied to an area of the sheet of paper 12 adjacent first edge 14. As should be understood by those skilled in the art, if adhesive were in addition or instead to be applied to the area of the sheet of paper 12 adjacent second edge 16, the adhesive would be applied to the lower (not visible in FIG. 1) side of sheet of paper 12.

Wrapper 10 also includes first 20 and second 22 score lines generally parallel with the first 14 and second 16 edges for facilitating folding of the sheet of paper 12. The first 20 and second 22 score lines are spaced such that when the first edge 14 is folded over onto itself along the first score line 20 and the second edge 16 is folded over onto itself toward the first edge 14 along the second score line 22, the first 14 and second 16 edges overlie and the sheet of paper 12 adheres to itself in the area of the adhesive 18, thereby forming a sleeve, which when opened, has a diameter corresponding to a diameter of the stack of coins. This relationship is described in more detail with reference to FIGS. 2–5 and the accompanying text below.

The wrapper 10 preferably includes printing 24 on an outside surface (visible surface in FIG. 1) of the sheet of paper 12. The printing 24 may for example consist of printing showing a denomination of the coins, printing showing a capacity of the wrapper in terms of number of coins, printing showing a capacity of the wrapper in terms of monetary value, and combinations of these. Instead or in addition, the printing 24 may consist of printing showing decorative designs 25 printing showing decorative backgrounds, and combinations of these. Further, the printing 24 may consist of printing relating to a logo, printing relating to an advertising message 27 and combinations of these. In addition, the printing 24 may consist of information useful to a bank 29, such as printing relating to an account holder's name, printing relating to an account holder's account number, printing relating to an account holder's telephone number and combinations of these.

In some instances, the wrapper 10 may also include printing 33 on an inside (shown in FIG. 2) surface of the sheet of paper 12. This printing may, for example, consist of information relating to advice for carefully handling one's money, information relating to savings advice, information relating to messages to children and/or adults concerning money responsibilities, promotional information, advertising information, information relating to special offers or coupons, information relating to instructions for assembling the wrapper and combinations of these.

Figure 2:
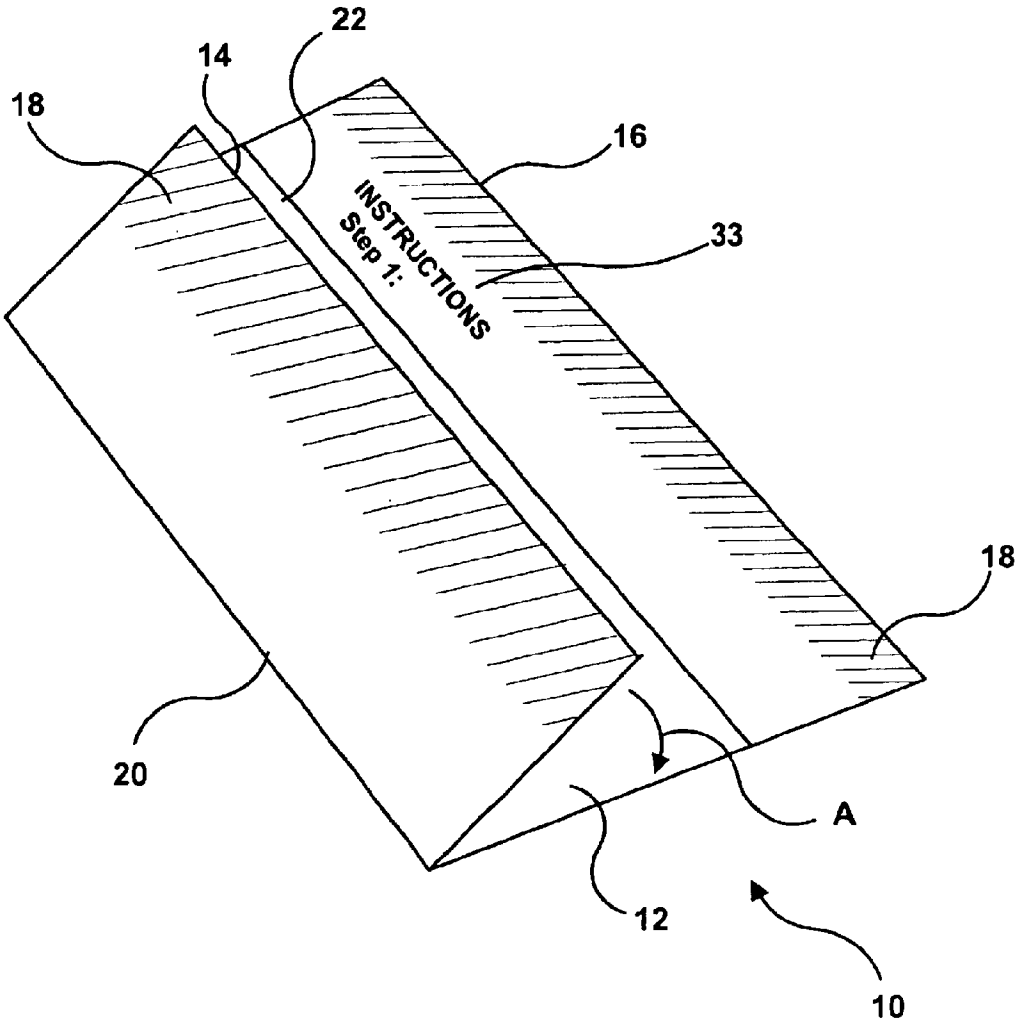
FIGS. 2–5 are isometric views illustrating a method for wrapping coins using the coin wrapper of FIG. 1.

The adhesive 18 may, for example, be a moisture activated adhesive, in which case it may be desirable for the moisture activated adhesive to be flavored, a pressure sensitive adhesive covered with a release liner 31 (shown broken away in FIG. 1), or a contact adhesive. In the case of a contact adhesive, it would be preferably that the adhesive 18 be applied to an area of the sheet of paper adjacent to both of the first edge 14 and the second edge 16. As mentioned above, as should be understood by those skilled in the art, if adhesive were in addition or instead to be applied to the area of the sheet of paper 12 adjacent second edge 16, the adhesive would be applied to the lower side of sheet of paper 12 (as shown in FIG. 2).

Figure 3:
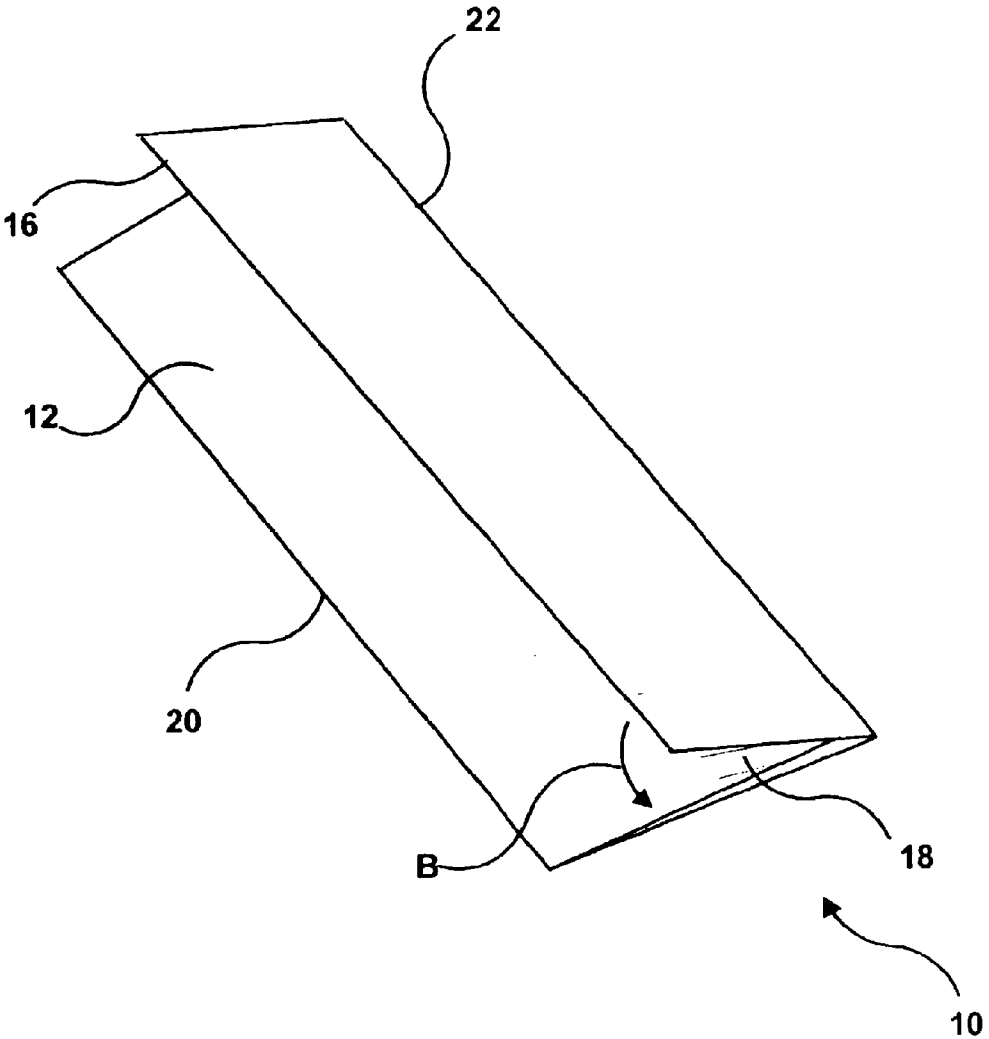
Figure 4:
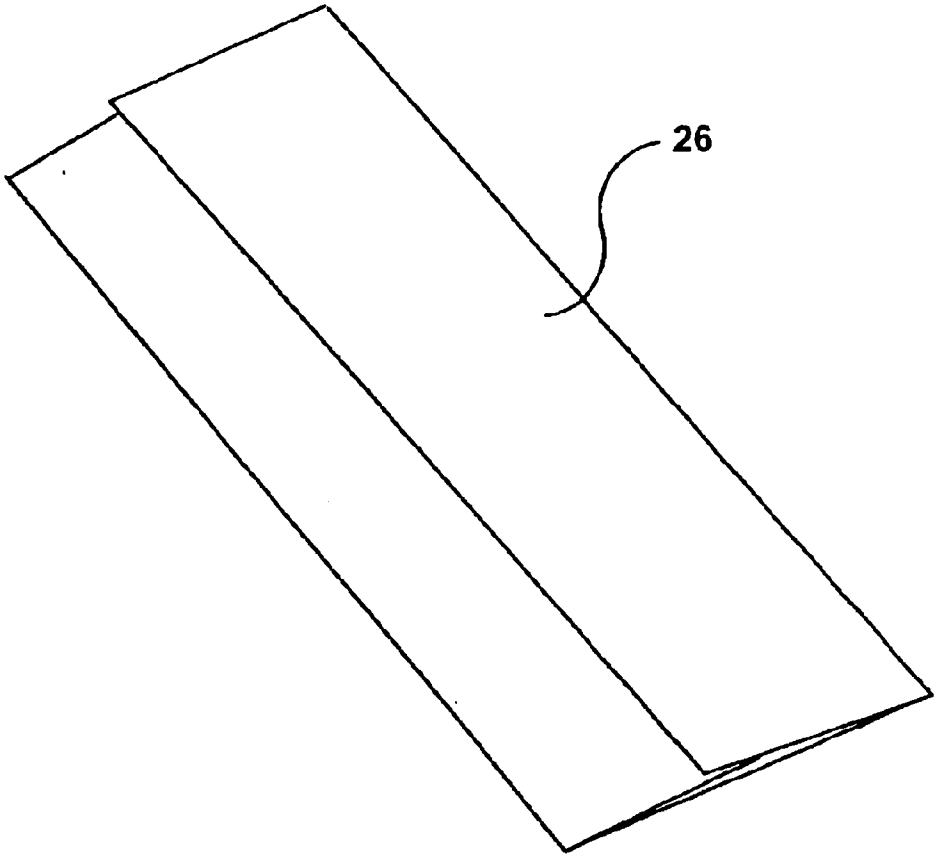
Figure 5:
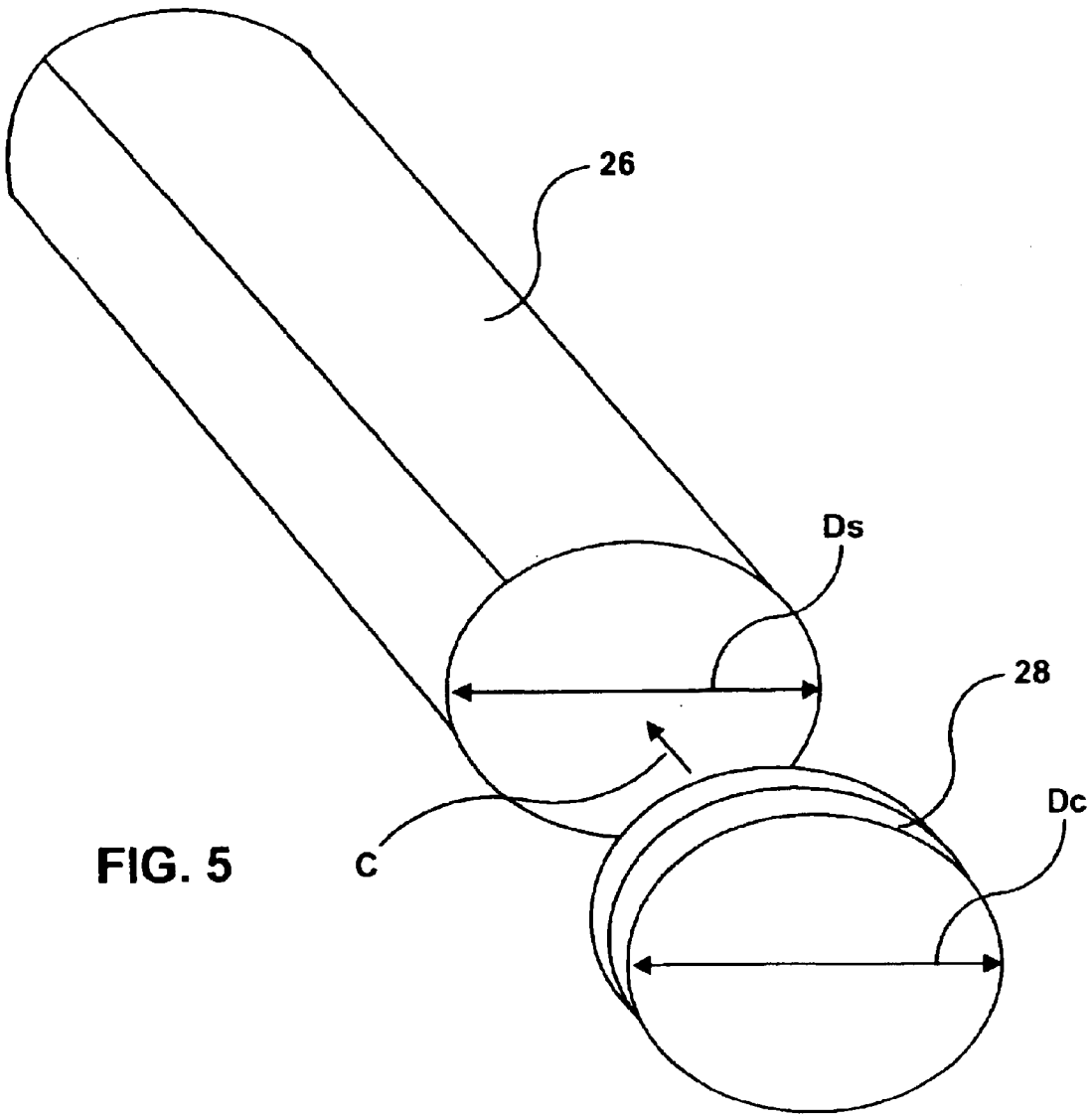

A method of wrapping coins using wrapper 10 is illustrated in FIGS. 2–5. A coin wrapper 10 as described above is first provided. Next, the first edge 14 is folded (indicated by arrow A) over onto itself along the first score line 20 (shown in FIG. 2). It should be noted that the adhesive 18 is facing outwardly. Then, as shown in FIG. 3, the second edge 16 is folded (indicated by arrow B) over onto itself toward the first edge 14 along the second score line 22 such that the first 14 and second edges 16 overlie and the sheet of paper 12 adheres to itself in the area of the adhesive 18, thereby forming a completed sleeve 26 (shown in FIG. 4). As shown in FIG. 5, the sleeve 26 is then opened such that the sleeve 26 has a diameter $D_s$ corresponding to (i.e., the same as or only slightly larger than) a diameter $D_c$ of the coins 28. Next, the coins 28 are inserted (indicated by arrow C) into the sleeve 26.

A method of creating coin wrapper 10 involves the steps of providing a flat sheet of paper 12 having first 14 and second 16 opposite edges generally parallel with each, and applying an adhesive 18 to an area of the sheet of paper adjacent to at least one of the first edge 14 or the second edge 16. First 20 and second 22 score lines are then formed generally parallel with the first 14 and second 16 edges for facilitating folding of the sheet of paper 12, the first 20 and second 22 score lines being spaced such that when the first edge 14 is folded over onto itself along the first score line 20 and the second edge 16 is folded over onto itself toward the first edge 14 along the second score line 22, the first 14 and second 16 edges overlie and the sheet of paper 12 adheres to itself in the area of the adhesive 18, thereby forming a sleeve, which when opened, has a diameter corresponding to a diameter of the stack of coins. The method may further include the steps of printing on an outside and/or inside surface of the sheet of paper 12.

Figure 6:
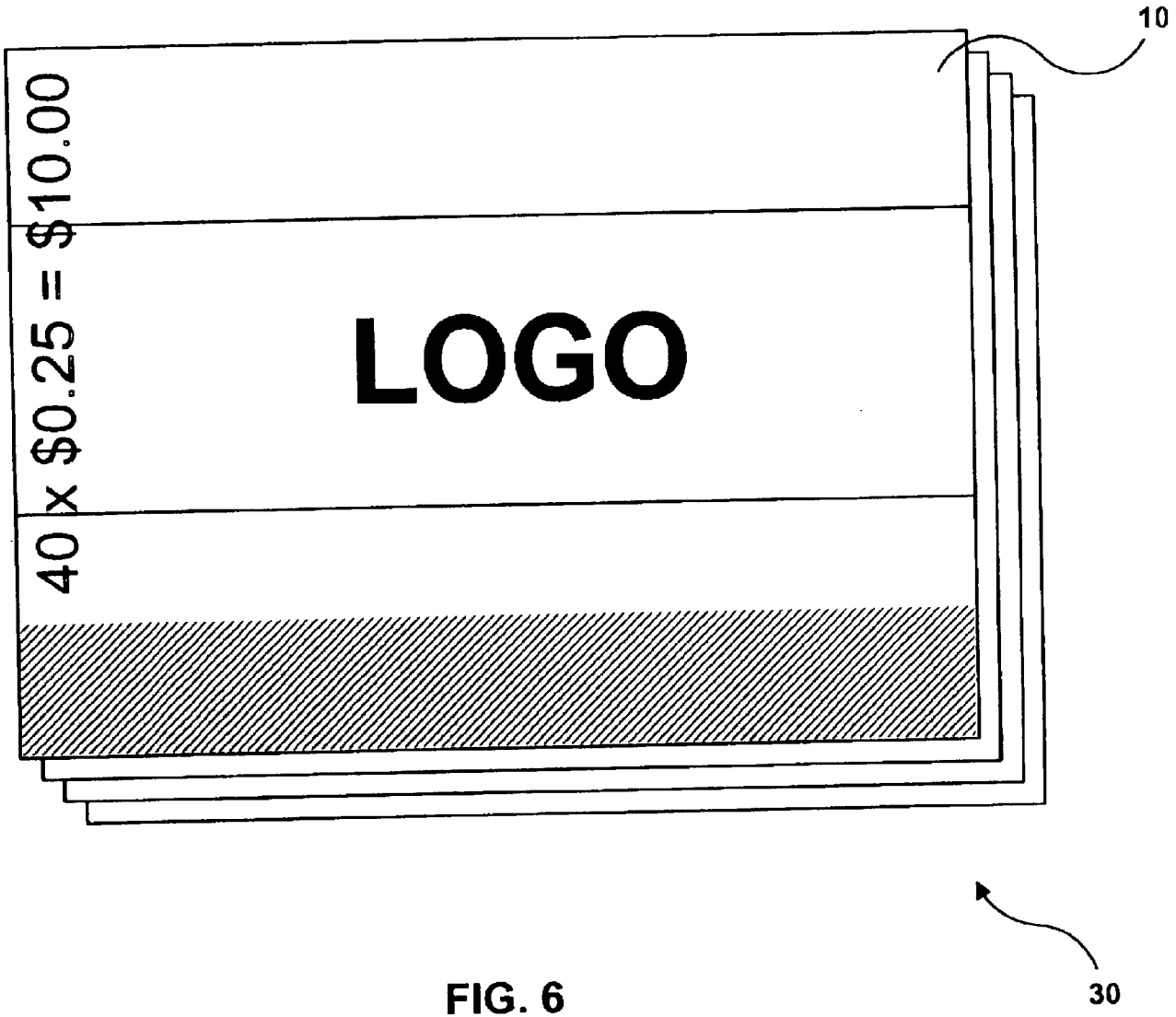
FIG. 6 is an isometric view showing a group of the coin wrappers of FIG. 1 joined together as a pad.

Referring now to FIG. 6, two or more wrappers 10 as described above may, if desired, be stacked on top of each other and separably joined together by any of known methods to form a pad 30 of coin wrappers.

Figure 7:
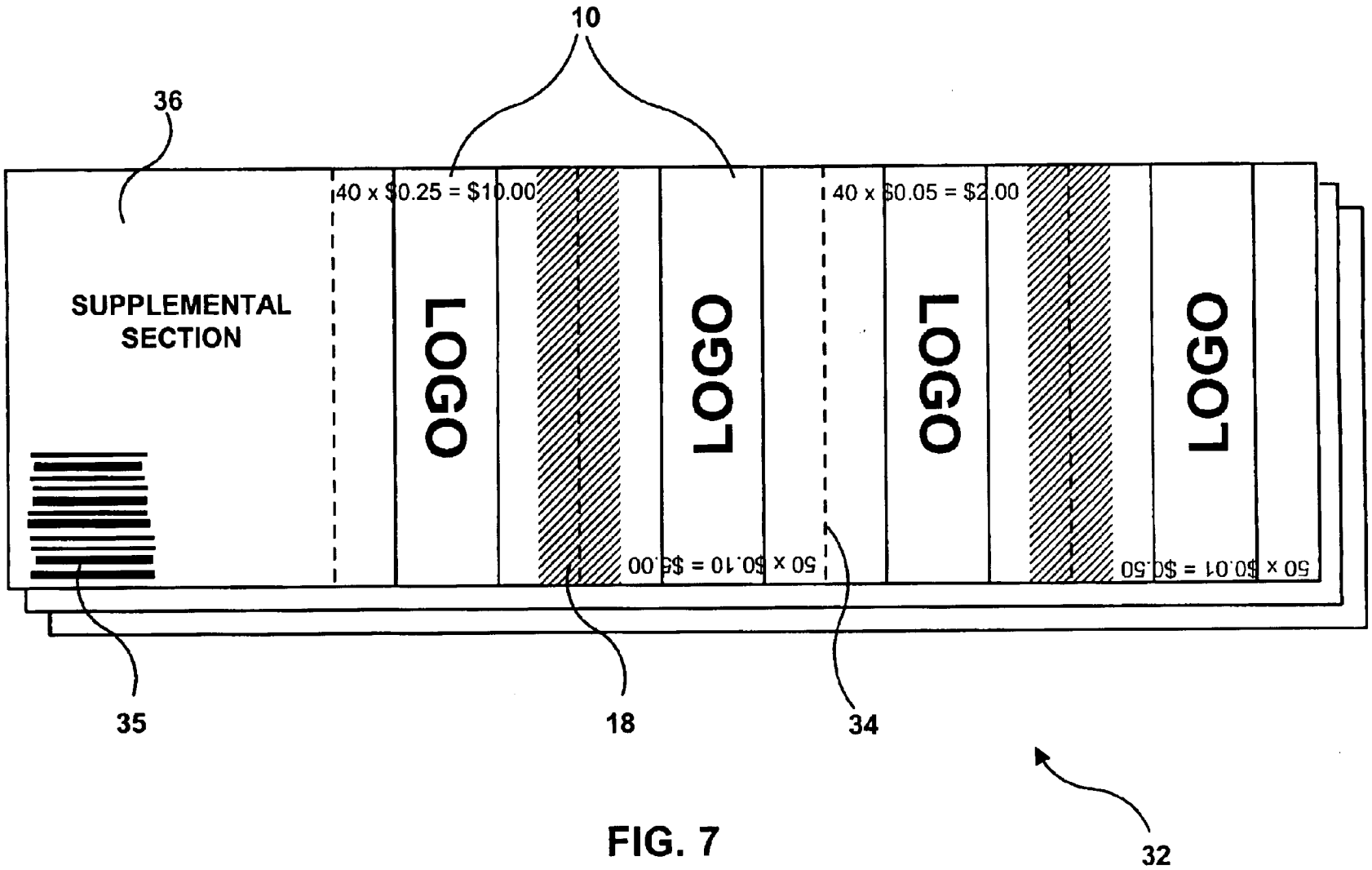
FIGS. 7 and 8 are plan views showing sets of coin wrappers, including the coin wrapper of FIG. 1.
Figure 8:
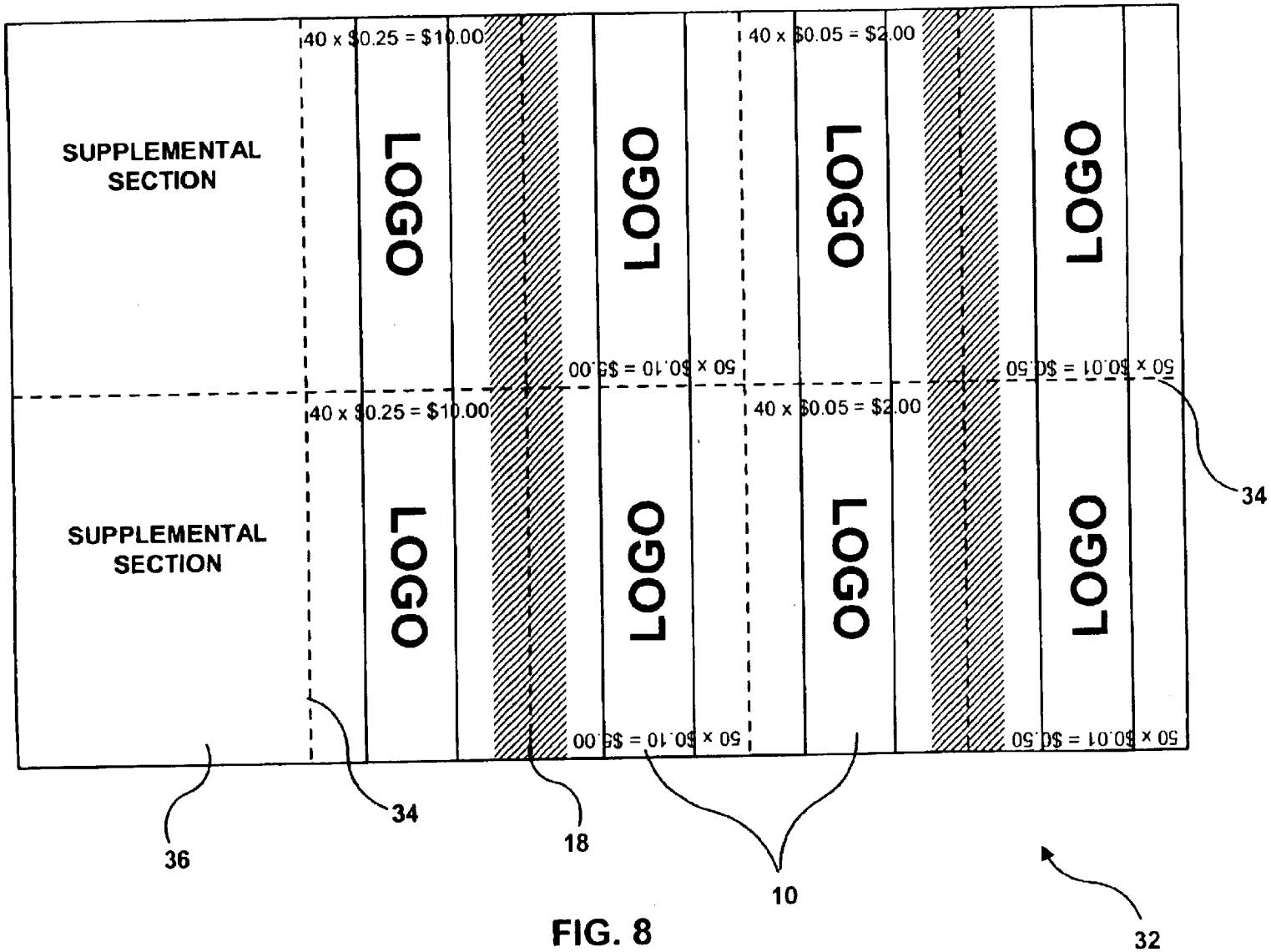

Referring now to FIGS. 7 and 8, a set 32 of coin wrappers for wrapping stacks of coins is shown, the set including a plurality of coin wrappers 10. Each of the plurality of coin wrappers 10 is configured as described above with respect to FIGS. 1–5. The plurality of coin wrappers 10 are detachably connected to one another along weakened lines 34 which facilitate separation of the plurality of coin wrappers 10 from each other. Preferably, the weakened lines 34 comprise perforations.

In certain embodiments, each of the plurality of coin wrappers 10 is configured to wrap the same denomination of coins, while in other embodiments, at least two of the plurality of coin wrappers 10 are configured to wrap different denominations of coins. For example, one of the plurality of coin wrappers 10 may be configured to wrap pennies, one of the plurality of coin wrappers 10 may configured to wrap nickels, one of the plurality of coin wrappers 10 may be configured to wrap dimes, and one of the plurality of coin wrappers 10 may be configured to wrap quarters. In other countries, the denominations of the wrappers will conform to that each country's currency. Preferably, the adhesive 18 is printed on abutting edges of coin wrappers (as shown in FIGS. 7 and 8) so as to facilitate creation of set 32.

The set 32 of coin wrappers may also include a supplemental section 36 in addition to the plurality of coin wrappers 10, the supplemental section 36 being detachably connected to at least one of the plurality of coin wrappers 10 along weakened lines 34 which facilitate separation of the supplemental section 36 from the plurality of coin wrappers 10. In certain embodiments, the supplemental section 36 may comprise an informational section containing information such as instructional information, a message to the consumer, a special offer or coupon, advertising information, a logo, and combinations of these. In other embodiments, the supplemental section 36 may comprise a retail header 35 section containing information such as a retail bar code, pricing information, sales information, and combinations of these. A second supplemental section may be added, for example, along the base after the last wrapper.

Two or more sets 32 of coin wrappers described above may, if desired, be stacked on top of each other and separably joined together to form a pad of sets 32 of coin wrappers (as shown in FIG. 7). A stack of coin wrapper sets 32 could even be stapled together, preferably through the supplemental section 36 of each. The number of sets 32 would be a suitable amount such as 5 per pad, 10 per pad or other appropriate number. These pads could have an instruction section at the top with the separable coin wrappers below, and with a hanging tab cut-out in the instruction section so the pad can hang on a retail rack.

Sets 32 of coin wrappers are used to wrap coins in the same manner as is disclosed above with respect to FIGS. 2–5, with the exception that, before folding the first edge 14, one of the coin wrappers 10 is separated from the plurality of coin wrappers 10 along the weakened lines 34.

Although sets 32 of coin wrappers need only each comprise two coin wrappers 10, it may be desirable to produce coin wrapper sets 32 in larger sheets. While printing generic background designs may be done on sheet fed equipment, web fed (roll) printing can also be used. For long run needs, the entire production can be done in a web fed manner. But to cater to a huge short run (custom printed) market, sheet fed production might be preferable. Whether one prints background designs of the paper stock on rolls or by sheets, for short run overprinting, it is preferable to cut the roll printed material to sheets, or to have produced the production on sheets from the beginning.

Once standard background designs have been printed, these are held in sheet form for custom printing when needed. The most ideal size would be to hold background sheets in a size of 11"×17" or 13"×19". At these sizes, three sets of coin wrap strips (each comprising one each for pennies, nickels, dimes and quarters or coin denominations of other countries) are on each sheet. Larger sizes could work if longer runs are to be done, but for shorter runs, this size sheet would be ideal. The reason for this is that to accomplish short runs, the sheets of wrappers which might already have a background design pre-printed, can now be run through a copier or digital printing machine to provide the short run customization.

The standard sheet (say 13"×19") would have a background design printed on it, and it would have the adhesive applied in the exact strip areas where it is needed. In addition the sheet would be perforated in the appropriate places so that the individual coin wraps can be easily separated from the sheet.

The sheet would have instructions printed along a side panel, or on the reverse side of the decoration (i.e. on the underside of the sheet). If one is to print the instructions on the underside of the sheet, it might be preferable to print this in a light color ink to avoid any show-through, such as a light gray color.

Besides the decorative or advertising side being on the top of the sheet, the back of the sheet could have other interesting or promotional graphics printed. For example if a bank is giving out these coin wraps as a service to its customers, the printing on the back of the sheet could provide general information about the services which a bank offers. Known coin wraps do not have printing on the inside because these items come already glued in sleeve form, so there is no point in printing on the inside of a current pre-made coin wrap.

Printing of the coin wraps can be done by offset printing (sheet fed or web), flexographic printing, gravure printing and by other methods such as digital or ink jet printing. Once the basic sheets are printed with any stock background designs or stock instructions further finishing can take place.

The sheets will have the strips of, for example, water soluble gum adhesive applied in appropriate areas. Other adhesives such as pressure sensitive can be applied to these specific areas either by liquid application with a release liner added, or by applying a transfer tape (which automatically comes with its own release liner.) A contact adhesive can also be added where no release liner is needed: This type of adhesive is the kind one would find on self-sealing envelopes. Also, as part of this operation, other types of popular adhesives can easily be applied such as UV cured adhesives.

Once printed, once the adhesive is applied and once the roll-paper has been sheeted to size, the sheets would then be sent through a machine which would score and perforate them. This perforating is to prepare the wrappers for ultimate separation by the consumer into individual wrappers. The score lines enable the user to fold the wrap at exactly the right places so that it will line up properly with the adhesive strips. It should be noted that the adding of adhesive as well as the scoring/perforating operations can also take place as an "in line" operation while the sheets are being printed.

The sheets can be "overprinted" in short runs or long runs with custom wording for a particular company, bank, school or other organization which desires a custom printed set of coin wraps. Once all the production as detailed above has been done, the finishing can take place in various ways. Sheets of a size approximately 13"×19" could hold three sets of wraps. Each set is on a strip approximately 4"×18", and this set would comprise of an instruction portion, and then 4 or more individual wraps, perforated for easy separation from each other. The 4 wraps could be of the same coin denomination, or they could be for different coins. These 13"×19" sheets can have perforations not only separating the individual wraps, but also separating the individual sets. They can then be delivered as 3 sets per sheet. Alternatively the 13"×19" sheets can be cut apart on a conventional paper cutting machine in to three separate sets. These are then delivered as one set per sheet, where the sheet size is about 4"×18". These 4"×18" sheets can be padded into groups of 5 sheets per pad, 10 sheets per pad, 50 sheets per pad, 100 sheets per pad, or other amount. This way they can be delivered as pads of coin wrap sets, and the sheets will not fly about when being kept on a shelf, or when being kept on a countertop in a bank where a sheet of wraps is given to each customer as a promotional gift. For retail sale, a pad comprising a smaller number of sheets may be appropriate.

Figure 9:
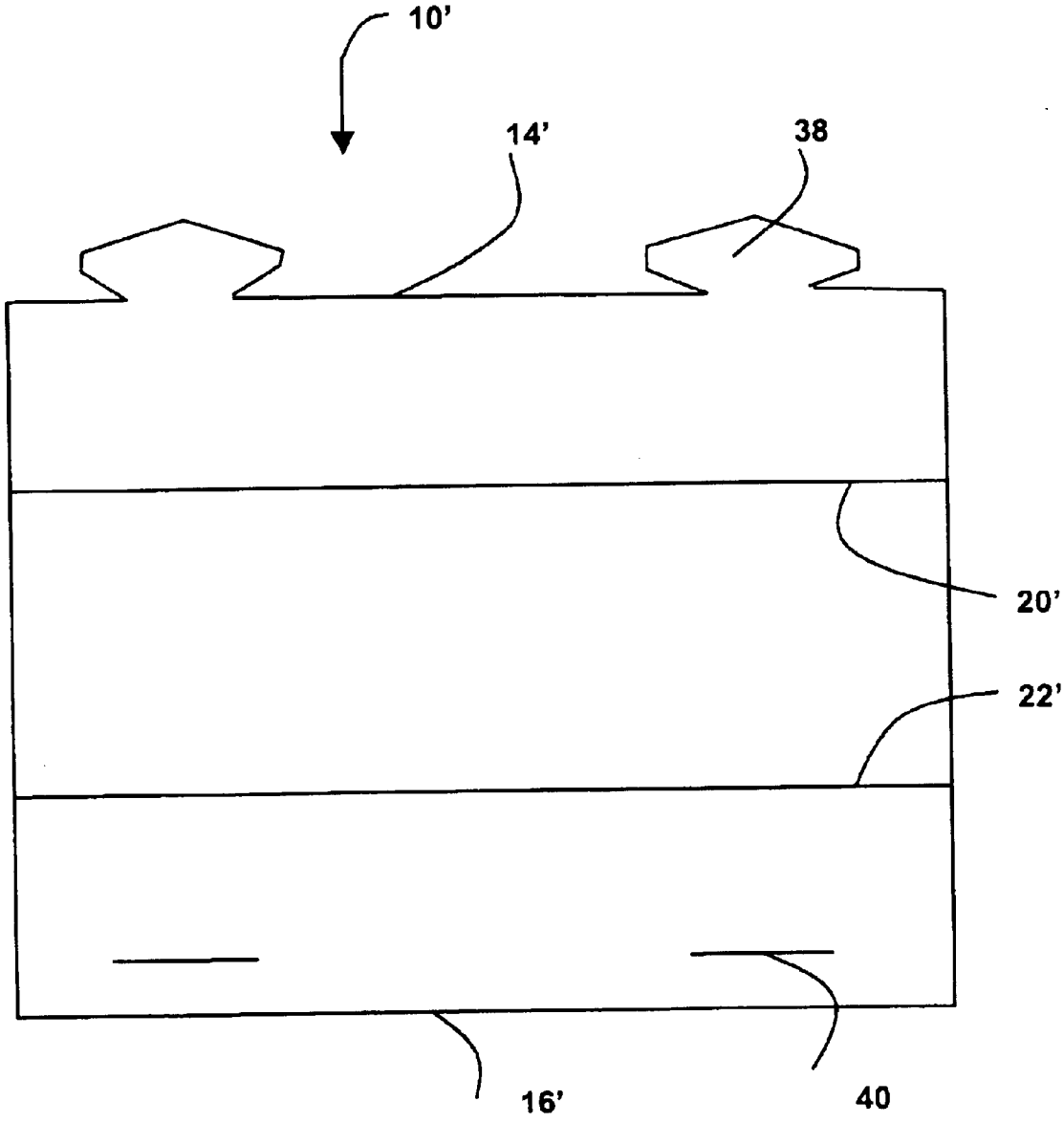
FIG. 9 is a plan view of a coin wrapper in accordance with another embodiment of the present invention.

Referring now to FIG. 9, a wrapper 10' for wrapping a stack of coins in accordance with another embodiment of the present invention is shown. The wrapper 10' is essentially the same as the wrapper 10 described above, with the exception that rather than an adhesive holding first edge 14' and second edge 16' together, one of first 14' or second edges 16' is provided with at least one tab 38 adjacent thereto, while the other is provided with at least one corresponding slit 40 for receiving tab 38 therein. First 20' and second 22' score lines of wrapper 10' are spaced such that when the first edge 14' is folded over onto itself along the first score line 20' and the second edge 16' is folded over onto itself toward the first edge 14' along the second score line 22', the at least one tab 38 engages the at least one slit 40, thereby forming a sleeve, which when opened, has a diameter corresponding to a diameter of the stack of coins, as is described in more detail with reference to FIGS. 2–5 and the accompanying text above.

The present invention, therefore, provides a coin wrapper and a method for wrapping coins using the coin wrapper which lends itself to attractive decorating and to short-run custom decorating/printing, which allows the wraps to be provided as joined-together sets, which allows the wraps to be provided as joined-together sets comprising the same or different coin denominations in the same set, which is practicable for home use and does not require the use of large, expensive and/or complex machinery for wrapping, which is easily stored, and which allows for the creation of a sleeve having the proper diameter for receiving the stack of coins before wrapping of the coins begins to facilitate wrapping.

The present invention also provides a coin wrapper which is easy to produce, easy to fill and close, one which is attractive to the consumer and which is made desirable by utilizing attractive colorful papers and/or the printing of pleasing designs onto the wrappers in one or more colors and which can be easily printed in short or long runs.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A set of coin wrappers for wrapping stacks of coins, said set of coin wrappers comprising:

a plurality of coin wrappers, each of said plurality of coin wrappers comprising:

a flat sheet of paper having first and second opposite edges generally parallel with each other;

an adhesive applied to an area of said sheet of paper adjacent to at least one of the first edge or the second edge; and first and second score lines generally parallel with the first and second edges for facilitating folding of said sheet of paper, said first and second score lines being spaced such that when the first edge is folded over onto itself along said first score line and the second edge is folded over onto itself toward the first edge along said second score line, the first and second edges overlie and said sheet of paper adheres to itself in the area of said adhesive, thereby forming a sleeve, which when opened, has a generally cylindrical shape with a diameter corresponding to a diameter of the stack of coins;

wherein said plurality of coin wrappers are detachably connected to one another along weakened lines which facilitate separation of said plurality of coin wrappers from each other; and wherein at least two of said plurality of coin wrappers are configured to wrap different denominations of coins.

2. The set of coin wrappers of claim 1 wherein said weakened lines comprise perforations.

3. The set of coin wrappers of claim 1 wherein at least two of said plurality of coin wrappers is configured to wrap the same denomination of coins.

4. The set of coin wrappers of claim 1 wherein one of said plurality of coin wrappers is configured to wrap pennies, wherein one of said plurality of coin wrappers is configured to wrap nickels, wherein one of said plurality of coin wrappers is configured to wrap dimes, and wherein one of said plurality of coin wrappers is configured to wrap quarters.

5. The set of coin wrappers of claim 1 further comprising at least one supplemental section in addition to the plurality of coin wrappers, said supplemental section being detachably connected to at least one of said plurality of coin wrappers along weakened lines which facilitate separation of said supplemental section from said plurality of coin wrappers.

6. The set of coin wrappers of claim 5 wherein said supplemental section comprises an informational section comprising information selected from the group consisting of instructional information, a message to the consumer, a special offer or coupon, advertising information, a logo, and combinations of these.

7. The set of coin wrappers of claim 5 wherein said supplemental section comprises a retail header section comprising information selected from the group consisting of a retail bar code, pricing information, sales information, and combinations of these.

8. A pad of sets of coin wrappers comprising a plurality of sets of coin wrappers stacked on top of each other and separably joined together, at least one of the plurality of sets of coin wrappers comprising a set of coin wrappers as claimed in claim 1.

9. A pad of sets of coin wrappers comprising a plurality of sets of coin wrappers stacked on top of each other and separably joined together, at least one of the plurality of sets of coin wrappers comprising:

a plurality of coin wrappers, each of said plurality of coin wrappers comprising:

a flat sheet of paper having first and second opposite edges generally parallel with each other;

an adhesive applied to an area of said sheet of paper adjacent to at least one of the first edge or the second edge; and first and second score lines generally parallel with the first and second edges for facilitating folding of said sheet of paper, said first and second score lines being spaced such that when the first edge is folded over onto itself along said first score line and the second edge is folded over onto itself toward the first edge along said second score line, the first and second edges overlie and said sheet of paper adheres to itself in the area of said adhesive, thereby forming a sleeve, which when opened, has a diameter corresponding to a diameter of the stack of coins; and wherein said plurality of coin wrappers are detachably connected to one another along weakened lines which facilitate separation of said plurality of coin wrappers from each other.

10. A set of coin wrappers for wrapping stacks of coins, said set of coin wrappers comprising:

a plurality of coin wrappers, each of said plurality of coin wrappers comprising:

a flat sheet of paper having first and second opposite edges generally parallel with each other;

an adhesive applied to an area of said sheet of paper adjacent to at least one of the first edge or the second edge; and first and second score lines generally parallel with the first and second edges for facilitating folding of said sheet of paper, said first and second score lines being spaced such that when the first edge is folded over onto itself along said first score line and the second edge is folded over onto itself toward the first edge along said second score line, the first and second edges overlie and said sheet of paper adheres to itself in the area of said adhesive, thereby forming a sleeve, which when opened, has a generally cylindrical shape with a diameter corresponding to a diameter of the stack of coins; and wherein said plurality of coin wrappers are detachably connected to one another along weakened lines which facilitate separation of said plurality of coin wrappers from each other; and at least one supplemental section in addition to the plurality of coin wrappers, said supplemental section being detachably connected to at least one of said plurality of coin wrappers along weakened lines which facilitate separation of said supplemental section from said plurality of coin wrappers.

11. The set of coin wrappers of claim 10 wherein said weakened lines comprise perforations.

12. The set of coin wrappers of claim 10 wherein each of said plurality of coin wrappers is configured to wrap the same denomination of coins.

13. The set of coin wrappers of claim 10 wherein at least two of said plurality of coin wrappers are configured to wrap different denominations of coins.

14. The set of coin wrappers of claim 13 wherein one of said plurality of coin wrappers is configured to wrap pennies, wherein one of said plurality of coin wrappers is configured to wrap nickels, wherein one of said plurality of coin wrappers is configured to wrap dimes, and wherein one of said plurality of coin wrappers is configured to wrap quarters.

15. The set of coin wrappers of claim 10 wherein said supplemental section comprises an informational section comprising information selected from the group consisting of instructional information, a message to the consumer, a special offer or coupon, advertising information, a logo, and combinations of these.

16. The set of coin wrappers of claim 10 wherein said supplemental section comprises a retail header section comprising information selected from the group consisting of a retail bar code, pricing information, sales information, and combinations of these.

17. A pad of sets of coin wrappers comprising a plurality of sets of coin wrappers stacked on top of each other and separably joined together, at least one of the plurality of sets of coin wrappers comprising a set of coin wrappers as claimed in claim 10.

* * * * *